US012343583B2

(12) United States Patent
Levinsohn

(10) Patent No.: US 12,343,583 B2
(45) Date of Patent: Jul. 1, 2025

(54) WEIGHTED CLOTHING ITEMS

(71) Applicant: LEVINSOHN TEXTILE CO., INC., New York, NY (US)

(72) Inventor: Adam Levinsohn, Morristown, NJ (US)

(73) Assignee: LEVINSOHN TEXTILE CO., INC., New York, NY (US)

( * ) Notice: Subject to any disclaimer, the term of this patent is extended or adjusted under 35 U.S.C. 154(b) by 0 days.

(21) Appl. No.: 17/744,184

(22) Filed: May 13, 2022

(65) Prior Publication Data

US 2022/0362615 A1 Nov. 17, 2022

Related U.S. Application Data

(60) Provisional application No. 63/188,909, filed on May 14, 2021.

(51) Int. Cl.

| | |
|---|---|
| ***A63B 21/065*** | (2006.01) |
| ***A63B 21/00*** | (2006.01) |
| ***A63B 21/06*** | (2006.01) |

(52) U.S. Cl.

CPC ..... *A63B 21/065* (2013.01); *A63B 21/0603* (2013.01); *A63B 21/4007* (2015.10)

(58) Field of Classification Search

CPC ..... A63B 21/065; A63B 21/0603; A63B 21/00058–00065; A63B 21/40–4009;

(Continued)

(56) References Cited

U.S. PATENT DOCUMENTS 3,759,510 A * 9/1973 Jackson, Jr. ..... A63B 21/0603 482/139
4,268,917 A * 5/1981 Massey ..... A63B 21/065 2/102

(Continued)

FOREIGN PATENT DOCUMENTS

JP 09291404 A 11/1997

OTHER PUBLICATIONS

"International Search Report and Written Opinion", issued by the European Patent Office, as International Searching Authority for PCT/US2022/029238 on Sep. 2, 2022, 11 pages.

(Continued)

*Primary Examiner* — Megan Anderson
*Assistant Examiner* — Kathleen M Fisk
(74) *Attorney, Agent, or Firm* — Kilpatrick Townsend & Stockton LLP

(57) ABSTRACT

A weighted article of wear for daily wear including a first panel having a plurality of first panel chambers and second panel having a plurality of second panel chambers, each of the first and second panel chambers further including a plurality of weighted pellets positioned therein; wherein each of the first and second panel chambers are defined by a seam line that separates each of the first and second panel chambers from a respective adjacent first panel chamber and second panel chamber for preventing the plurality of weighted pellets from moving between adjacent first panel chambers and adjacent second panel chambers; and wherein the plurality of weighted pellets are distributed within each of the first panel chambers and each of the second panel chambers so that the first panel weighs more than the second panel and the plurality of weighted pellets are not redistributable by a wearer.

17 Claims, 3 Drawing Sheets

(58) Field of Classification Search
CPC .. A63B 21/4023–4025; A41D 13/0015; A41D 2600/10
See application file for complete search history.

(56) References Cited

U.S. PATENT DOCUMENTS

| | | | | |
|---|---|---|---|---|
| 4,658,442 | A | 4/1987 | Tomlinson et al. | |
| 5,002,270 | A * | 3/1991 | Shine | A63B 21/065 2/102 |
| 5,048,125 | A * | 9/1991 | Libertini | A63B 21/0603 2/79 |
| 5,553,322 | A | 9/1996 | Cebo-Johnson | |
| 5,659,898 | A | 8/1997 | Bell, Jr. | |
| 5,784,716 | A | 7/1998 | Holt et al. | |
| 6,314,580 | B1 | 11/2001 | Greenberg et al. | |
| 6,557,176 | B2 * | 5/2003 | Franco-Sion | A63B 21/065 2/102 |
| 6,671,887 | B1 | 1/2004 | Eligan et al. | |
| 6,692,413 | B1 | 2/2004 | Greenberg et al. | |
| 6,834,396 | B2 * | 12/2004 | Franco-Sion | A63B 21/065 2/102 |
| 7,090,558 | B2 | 8/2006 | Ott | |
| 7,708,673 | B2 | 5/2010 | Gibson-horn | |
| 7,870,623 | B2 * | 1/2011 | Judd | A63B 21/4007 5/655.4 |
| 8,215,773 | B2 | 7/2012 | Gibson-Horn et al. | |
| 8,245,322 | B1 | 8/2012 | Bouza | |
| 8,443,465 | B2 * | 5/2013 | Stewart | A63B 21/0601 2/96 |
| D707,424 | S | 6/2014 | Pezzimenti | |
| D734,922 | S | 7/2015 | Docker | |
| 9,072,935 | B2 * | 7/2015 | Ross | A63B 23/047 |
| D746,548 | S | 1/2016 | Ingram | |
| D747,849 | S | 1/2016 | Ingram | |
| D748,374 | S | 2/2016 | Ingram | |
| 9,301,554 | B2 | 4/2016 | Whaley | |
| RE46,069 | E | 7/2016 | GibsonHorn et al. | |
| D770,138 | S | 11/2016 | Borovicka | |
| D770,730 | S | 11/2016 | Borovicka | |
| D783,934 | S | 4/2017 | Borovicka | |
| D788,404 | S | 6/2017 | Van Sisseren | |
| D799,791 | S | 10/2017 | Ingram | |
| D799,792 | S | 10/2017 | Ingram | |
| 9,795,821 | B2 | 10/2017 | Feldman | |
| 10,045,572 | B2 * | 8/2018 | Bratcher | A41D 13/0015 |
| 10,065,065 | B2 | 9/2018 | Herron | |
| 10,322,309 | B2 | 6/2019 | Feldman | |
| 11,219,248 | B2 * | 1/2022 | Young | A41D 13/0012 |
| 2002/0010058 | A1 | 1/2002 | Myrick | |
| 2003/0092544 | A1 | 5/2003 | Reed | |
| 2006/0046913 | A1 | 3/2006 | Squittieri | |
| 2006/0090240 | A1 | 5/2006 | McKenzie et al. | |
| 2007/0173385 | A1 | 7/2007 | Cohenca et al. | |
| 2010/0248915 | A1 | 9/2010 | Gibson-Horn | |
| 2010/0319099 | A1 | 12/2010 | Washington et al. | |
| 2011/0274903 | A1 | 11/2011 | Stuart et al. | |
| 2013/0298302 | A1 | 11/2013 | Whaley et al. | |
| 2014/0005010 | A1 | 1/2014 | Kaminsky | |
| 2015/0335853 | A1 | 11/2015 | Orewiler et al. | |
| 2017/0157447 | A1 | 6/2017 | Brown | |
| 2018/0111016 | A1 | 4/2018 | Brockway et al. | |
| 2019/0022450 | A1 | 1/2019 | Martinoli Sanz | |

OTHER PUBLICATIONS

"Hyper Vest Pro Weight Vest", Available Online at: https://www.hyperwear.com/product/weight-vest/, Accessed from Internet on May 12, 2022, 10 pages.

"Hyper Vest Elite Weight Vest", Available Online at: https://www.hyperwear.com/product/weighted-vest/, Accessed from Internet on Aug. 25, 2022, 10 pages.

"Adult Weighted Vests for Men or Women", Etsy, Available Online at: https://www.etsy.com/listing/488546830/adult-weighted-vests-for-men-or-women?ga_order=most_relevant&ga_search_type=all&ga_view_type=gallery&ga_search_query=weighted+adult+vest&ref=sr_gallery-1-2&frs=1, Accessed from Internet on Aug. 24, 2022, 9 pages.

"Bala Bangles 1 Lb. Weights", Free People, Available Online at: https://www.freepeople.com/shop/bala-bangles-1lbweights2/category=fpmovementgear&color=010&type=REGULAR&size=One%20Size&quantity=1, Accessed from Internet on Aug. 24, 2022, 6 pages.

"Hyper Vest Fit Weight Vest", Hyperwear fitness, Available Online at: https://www.hyperwear.com/product/walking-weighted-vest/?attribute_size=Large&attribute_weight=8+LBS&gclid=CjwKCAiAjeSABhAPEiwAqfxURfaJibrck4KufkiWM3hFfM7Va68hiE0bH2YlocJEOMEu1FI_Zedb2RoCQ2UQAvDBwE, Accessed from Internet on Aug. 24, 2022, 9 pages.

"Kilogear Cut", Available online at https://kilogearcut.com/, 2019, 4 pages.

"Speed-Wear Weighted Apparel", Gopher Performance, Available Online at: https://www.gopherperformance.com/conditioning/resistance/speed-wear?item=13612, Accessed from Internet on Sep. 8, 2022, 4 pages.

"St Barts Down Vest", Cotes of London, Available Online at: https://coteslondon.com/collections/womens/products/st-barts-down-vest, Accessed from Internet on Aug. 24, 2022, 9 pages.

"Weight Vest—Jazz Purple (4 Lbs of Weight Thins™ Included)", Challenge Workout wear, Available Online at: https://challengeweightedworkoutwear.com/collections/shop/products/weight-vest-jazz-purple, 2022, 9 pages.

"Weighted Adult Vest", Etsy, Available Online at: https://www.etsy.com/market/weighted_adult_vest?ref=cq_tag_raised_image-6, Accessed from Internet on Aug. 24, 2022, 12 pages.

"Weighted Fleece Hoodie", Autism Weighted Hoodie for Autism, Available Online at: https://funandfunction.com/weighted-fleece-hoodie.html, Accessed from Internet on Aug. 24, 2022, 12 pages.

"Weighted Hoodie", Weighted Sweatshirt—Heavy Hoodie, Available online at: https://www.autism-products.com/product/weighted-hoodie/?attribute_pa_size=small-2&keyword_session_id=vt~adwords|kt~|mt~|ta~170573294043&_vsrefdom=w . . . , Accessed from Internet on Aug. 24, 2022, 5 pages.

"Weighted Pocket Scarf™", Fun and Function, Available Online at: https://funandfunction.com/weighted-pocket-scarftm.html, Accessed from Internet on Aug. 24, 2022, 9 pages.

"Zip-Up Weighted Vest", Fun and Function, Available Online at: https://funandfunction.com/zip-up-weighted-vest.html, Accessed from Internet on Aug. 24, 2022, 9 pages.

"Bear Hug Weighted Wraps (L-XL)", Available Online at: https://www.autism-products.com/product/bear-hug-weighted-wraps-l-xl/, 2018, Accessed from Internet on Aug. 20, 2022, 2 pages.

"Soft Weighted Vest", Available Online at: https://www.autism-products.com/product/soft-weighted-vest/, 2018, Accessed from Internet on Aug. 20, 2022, 3 pages.

"Weighted Vests", Available Online at: https://www.autism-products.com/product/weighted-vests/#, 2018, Accessed from Internet on Aug. 20, 2022, 2 pages.

International Application No. PCT/US2022/029238 , "International Preliminary Report on Patentability", mailed on Nov. 23, 2023, 9 pages.

* cited by examiner

WEIGHTED CLOTHING ITEMS

CROSS REFERENCE TO RELATED APPLICATION

This application claims the benefit of U.S. Provisional Application No. 63/188,909, filed May 14, 2021, entitled "Weighted Clothing Items," the entire contents of which are incorporated herein by reference.

FIELD OF INVENTION

The present invention is generally related to weighted articles of wear, and in particular to weighted clothing items for daily wear.

BACKGROUND

Weighted clothing may be worn while a wearer is exercising so as to increase the intensity of the workout for the wearer. Such weighted clothing is conventionally designed specifically to only be worn during exercising and to permit the weight of the clothing item to be adjusted by the wearer by attaching weights to the garment, hanging weights from the garment, or inserting weights into pockets of the garments. This can lead to shifting weight during use, incorrect weight distribution, incorrect weight to size ratio, and bulky and uncomfortable weighted clothing, which can all lead to an increase in the likelihood of injury of the wearer.

BRIEF DESCRIPTION OF THE DRAWINGS

A further understanding of the nature and advantages of various embodiments may be realized by reference to the following figures. In the appended figures, similar components or features may have the same reference label.

DETAILED DESCRIPTION

The subject matter of embodiments of the present invention is described herein with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "upper," "lower," "down," "top," "left," "right," "bottom," among others, are intended to refer to the orientation as illustrated and described in the figure (or figures) to which the components and directions are referencing.

Certain embodiments and features of the present disclosure relate to weighted articles of wear, including but not limited to weighted vests, for daily wear that may provide a fashionable article of wear with fitness and/or calming benefits due to the varied distribution of weight throughout the article of wear. The weighted article may include a plurality of areas or panels that define regions of the article, the plurality of panels may also each include a plurality of chambers that may contain a weighted material, for example but not limited to weighted pellets. The weighted material may be selectively distributed through various chambers to provide weight in certain areas of the article. The amount of weight provided in select chambers and thereby select panels can provide for a weighted article that may be used for a desired effect. For example, in some embodiments, weight may be distributed in a manner so as to provide an article of clothing for aiding in posture improvement, for use while walking/hiking, for balance improvement, for bone density improvement, for calming of anxiety, for increased calorie burning, for strength training, etc. The weight provided in each chamber of the panels may be further selected based on the user, for example man, woman, or child and further based on a size such as Small, Medium, Large, X-Large, etc. The chambers can provide for selective placement of the weighted material during manufacturing such that the weighted material does not move between chambers thereby limiting potential injury caused by shifting of the weighted material to an undesired location.

Though the weighted article of wear is mainly discussed relative to a weighted vest, any other weighted article of wear and/or clothing item may be similarly formed, e.g., a weighted jacket, a weighted shirt, weighted shorts, weighted pants, weighted footwear, weighted scarf accessories, etc.

Figure 1B:
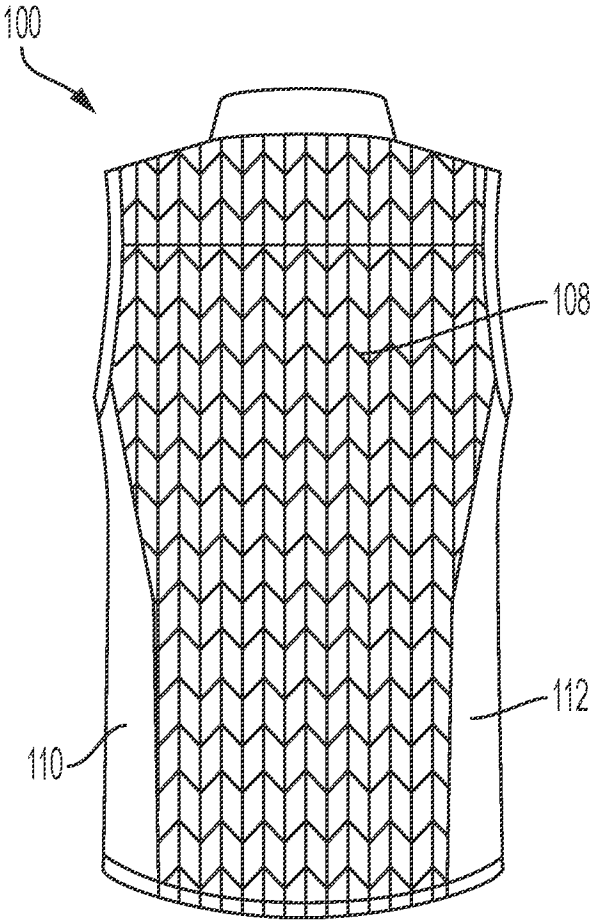
FIGS. 1A-1B illustrate several views of a weighted vest according to certain embodiments of the present disclosure.
Figure 1A:
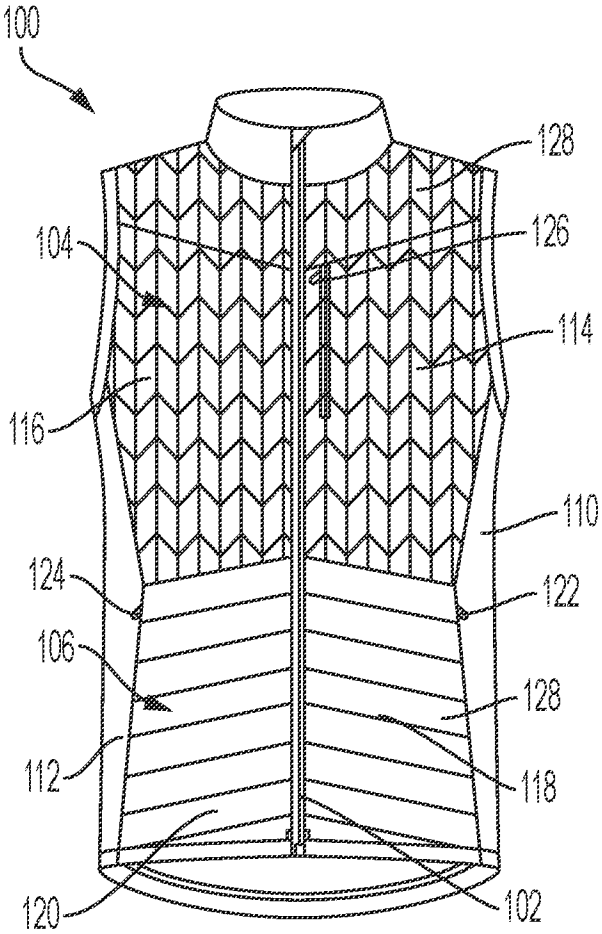

According to certain embodiments of the present disclosure, a weighted clothing item, including but not limited to a weighted vest 100 as shown in FIGS. 1A and 1B, may include a plurality of panels that form the weighted vest 100, a plurality of pockets, and a closure element 102. The plurality of panels may include, but are not limited to, a front upper body panel 104, a front lower body panel 106, a rear body panel 108, a left side panel 110, and a right side panel 112. The weighted vest 100 may include a plurality of chambers 128 that may include a weighted material. The distribution of the weighted material within the chambers 128 may be selected to provide a desired effect, for example for posture improvement, for use while walking/hiking, for balance improvement, for bone density improvement, for calming anxiety, for increasing calorie burning, for strength training, etc. The distribution of weighted material in the various panels of the weighted vest 100 can also be selected based on the size of the person for whom the weighted vest 100 is intended for, for example a woman or a man, in addition the weighted vest 100 may be provided in various sizes for women, men, and children.

The front lower body panel 106 may extend from a lower front edge of the weighted vest 100 to a lower rib area of the weighted vest 100 and between the left side panel 110 and the right side panel 112. In some embodiments, the front lower body panel 106 may be selectively filled with weighted material. The front upper body panel 104 may extend from the lower rib area of the weighted vest 100 to a shoulder area of the weighted vest 100. The front upper body panel 104 may extend between the left side panel 110 and the right side panel 112. The front upper body panel 104 may also extend between two arm openings in the weighted vest 100. In some embodiments, the front upper body panel 104 may be selectively filled with weighted material. The amount of weighted material filled in the front lower body panel 106 may differ from the amount of weighted material filled in the front upper body panel 104 such that the front lower body panel 106 makes up a different percentage of the overall weight of the weighted vest 100 than the front upper body panel 104.

In some embodiments, the front lower body panel 106 and the front upper body panel 104 may be adjacent to each other in the lower rib area of the weighted vest 100. Additionally, the closure element 102 may extend at least partially through at least one of the front lower body panel 106 or the front upper body panel 104. For example, the closure element 102 may extend from the lower front edge of the weighted vest 100 to an upper front edge and/or an upper collar edge of the weighted vest 100 such that the front lower body panel 106 and/or the front upper body panel 104 are each divided into two portions.

In some embodiments, the front upper body panel 104 may include a left front upper body panel 114 and a right front upper body panel 116, which may be separated by the closure element 102. In some embodiments, the front lower body panel 106 may include a left front lower body panel 118 and a right front lower body panel 120, which may be separated by the closure element 102. The plurality of pockets may include a left hand pocket 122, a right hand pocket 124, and a chest pocket 126, though in some embodiments the weighted clothing item may include more or fewer pockets, including no pockets. The closure element 102 may be at least one of a zipper, a plurality of buttons, a hook and loop fastener, a magnetic fastener, a snap, a clasp, a lace, etc. such that the wearer can easily don and doff the weighted vest 100. The closure element 102 may aid in securing the weighted vest 100 about the body of the wearer in a particular orientation.

The rear body panel 108 may extend from a lower rear edge of the weighted vest 100 to the shoulder area of the weighted vest 100. The rear body panel 108 may extend between the left side panel 110 and the right side panel 112. The rear body panel 108 may also extend between the two arm openings in the weighted vest 100. In some embodiments, the rear body panel 108 may be selectively filled with weighted material. The amount of weighted material filled in the rear body panel 108 may differ from the amount of weighted material filled in the front upper body panel 104 and/or the front lower body panel 106 such that the rear body panel 108 makes up a different percentage of the overall weight of the weighted vest 100 than the front upper body panel 104 and/or the front lower body panel 106. In some embodiments, the rear body panel 108 and the front upper body panel 104 are adjacent to each other in the shoulder area of the weighted vest 100.

The plurality of panels that form the weighted vest 100 may each be integrally formed with one another or may each be separately formed and then joined together to form the weighted vest 100 by seaming, sewing, gluing, or any other suitable method of attaching the plurality of panels to one another. Additionally, the plurality of panels, e.g., the front upper body panel 104, the front lower body panel 106, the rear body panel 108, the left side panel 110, the right side panel 112, etc., may be separated from each other by intermediate panels that are used to join together the plurality of panels of the weighted vest 100. In some embodiments, each of the plurality of panels may be made from the same material, different material, or a combination of the same and different material. For example, the plurality of panels may each be formed from any combination of natural fibers, non-natural fibers, or other suitable material. For example, the plurality of panels may include one or more of cotton, velvet, velour, wool, linen, polyester, nylon, flannel, canvas, or any other suitable material.

In some embodiments, the left side panel 110 and the right side panel 112 may be formed from a material with elastic properties. Additionally, the left side panel 110 and the right side panel 112 may each be formed of a more elastic material than each of the front upper body panel 104, the front lower body panel 106, and the rear body panel 108. Forming the left side panel 110 and the right side panel 112 of an elastic material enables the weighted vest 100 to stretch and adjust to the size and shape of a wearer for optimal fit of the weighted vest 100. The use of an elastic material may also aid in providing a snug fit to a user such that the weight provided in the weighted vest 100 remains in the desired position during wearing with minimal shifting or movement.

The left side panel 110 may be arranged between the left front upper body panel 114 and the left front lower body panel 118 on the front of the weighted vest 100 and the rear body panel 108 on the back of the weighted vest 100. The right side panel 112 may be arranged between the right front upper body panel 116 and the right front lower body panel 120 on the front of the weighted vest 100 and the rear body panel 108 on the back of the weighted vest 100.

One or more of the front upper body panel 104, the front lower body panel 106, or the rear body panel 108 may include one or more chambers 128, e.g., quilts or baffles, formed between at least two layers of material forming the various panels. The chambers 128 form separate compartments in each of the panels and may be created using sewn-through construction, box-baffling construction, or other suitable constructions for providing a chamber 128. In sewn-through construction, the two layers of material are sewn together at the outer edges of each chamber 128. In the box-baffling construction, a material is placed between and substantially perpendicular to the two layers of material at the outer edges of each chamber 128 to form a box.

The chambers 128 formed in each of the front upper body panel 104, the front lower body panel 106, and the rear body panel 108 may be any suitable shape or pattern. For example, the chambers 128 may be squares, rectangles, triangles, trapezoids, parallelograms, circles, ovals, etc. In some embodiments, the chambers 128 of the left front upper body panel 114, the right front upper body panel 116, and the rear body panel 108 may form a chevron or herringbone pattern. In some embodiments, other patterns may be formed by the chambers 128 and the patterns may differ or be the consistent between panels. Additionally, the chambers 128 may be the same or different sizes and/or shapes within each of the plurality of panels.

The chambers 128 may be filled with weighted material or pellets to add weight to the weighted vest 100. For example, the chambers 128 may be filled with glass beads, plastic or polymer beads, wood beads, crystal beads, metal beads, or beads formed of any other similarly weighted natural and/or artificial material. The weighted material may comprise a material that is durable and washable such that the entire weighted clothing item, for example the weighted vest 100 may be washed in a washing machine. The chambers 128 may be formed such that the weighted material does not move between respective chambers 128 during wearing and/or washing. In some aspects, the weighted pellets may be of a material that retains heat such that the weighted vest 100 may be warmed up for providing weighted pressure as well as heat application. In some aspects, the weighted pellets may be of a material that is insulated or provides cooling properties such that the weighted vest may be cooled so as to provide weighted pressure as well as an application of a cold temperature.

The use of weighted pellets or other weighted materials within the chambers 128 to add weight to the weighted vest 100 enables a precise weight distribution throughout the weighted vest 100 without creating a bulky or unattractive appearance. In some aspects, the weighted pellets may not be rearranged or redistributed by the wearer after the weighted vest 100 is formed. In some embodiments, the chambers 128 are sized and/or shaped to retain the weighted pellets within each chamber 128 without allowing the weighted pellets to move between adjacent chambers 128 such that the weighted vest 100 provides for a desired amount of weight in the various chambers 128 of the weighted vest 100.

In some embodiments, the chambers 128 may also be filled with a polyester fill along with the weighted pellets. The weighted pellets may be dispersed throughout the polyester fill in each of the chambers 128. The polyester fill may prevent the weighted pellets from moving significantly within each chamber 128. The weighted pellets may be maintained in the respective chambers 128 such that they cannot move between chambers 128.

In some embodiments, the left side panel 110 and the right side panel 112 may be free of any chambers 128 and/or any weighted pellets. For example, the left side panel 110 and/or the right side panel 112 may comprise a material without chambers 128 which may comprise an elastic material to provide for expansion and contraction of the side regions so as to aid in fitting the weighted vest 100 to a variety of body shapes and sizes. There may also be additional areas of the weighted vest 100 that are free of any chamber 128 and/or any weighted pellets, e.g., a collar region, an edge binding region, etc. In addition, some chambers 128 may not include weighted pellets.

By integrating the weighted pellets into the vest construction, proper weight distribution throughout the weighted vest 100 may be ensured and carefully considered to increase the benefit and efficacy of the weighted vest 100. And incorporating the weighted pellets into the various chambers 128 may prevent undesired shifting of the weight pellets and thereby the weight provided within the weighted vest 100 during use by a wearer, which may reduce the likelihood of injury to the wearer.

The chambers 128 may be specifically designed and arranged on the panels to provide the weighted vest 100 with a fashionable and aesthetically pleasing appearance. For example, as previously mentioned, the chambers 128 of the left front upper body panel 114, the right front upper body panel 116, and the rear body panel 108 may form a chevron pattern or other patterns and the chambers 128 of the left front lower body panel 118 and the right front lower body panel 120 may form a pattern of stacked, elongated parallelograms that slant down and away from the closure element 102, or other pattern. While these specific patterns are discussed herein, any suitable pattern or combination of patterns may be incorporated into the panels of the weighted vest 100.

Figure 2B:
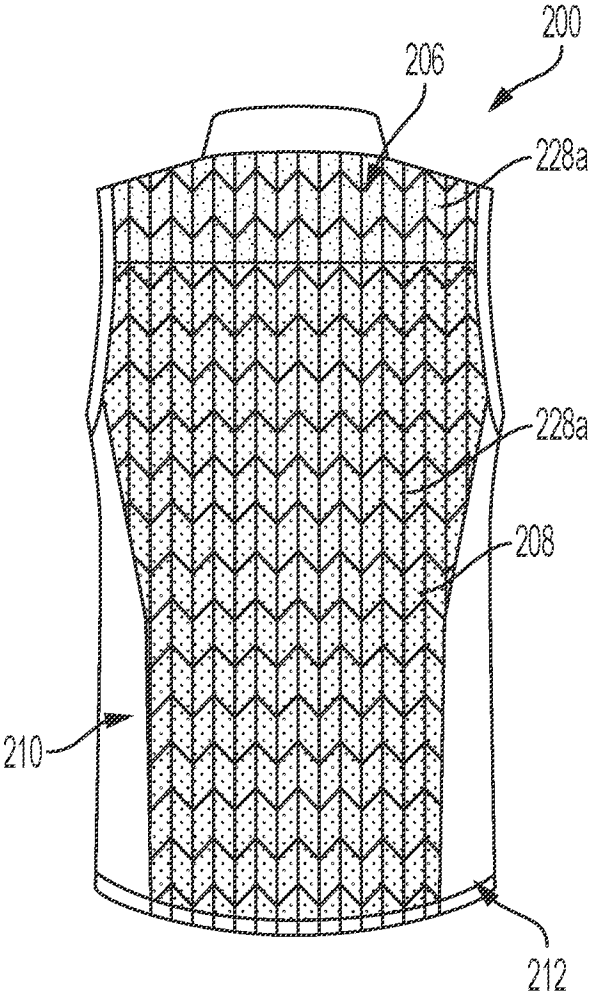
FIGS. 2A-2B illustrate several views of a weighted vest with notations of the weight distribution according to certain embodiments of the present disclosure.
Figure 2A:
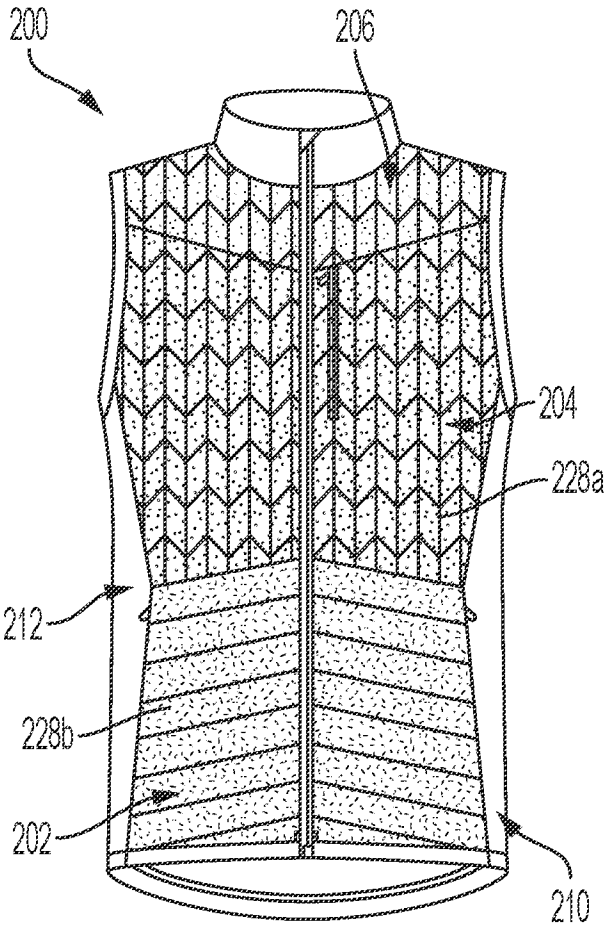

According to certain embodiments of the present disclosure, as shown in FIGS. 2A and 2B, a weighted clothing item, including but not limited to a weighted vest 200, may be the same as the weighted vest 100 and/or include the same or similar elements as the weighted vest 100 discussed in relation to FIGS. 1A and 1B. For example, the weighted vest 200 may include a plurality of panels, a plurality of pockets, and a closure element. The weighted vest 200 may include a plurality of chambers 228*a*, 228*b* that may include a weighted material. The distribution of the weighted material within the chambers 228*a*, 228*b* may be selected to provide a desired effect, for example for posture improvement, for use while walking/hiking, for balance improvement, for bone density improvement, for calming anxiety, etc. The distribution of weighted material in the various panels of the weighted vest 200 can also be selected based on the size of the person for whom the weighted vest 200 is intended for, for example a woman or a man, in addition the weighted vest 200 may be provided in various sizes for women, men, and children.

In some embodiments, the plurality of panels includes a front torso panel 202, which is filled with dash-type markings in FIG. 2A, a front chest panel 204, which is filled with dotted markings in FIG. 2A, a shoulder panel 206, which is filled with smaller dotted markings in FIGS. 2A and 2B, and a rear body panel 208, which is filled with dotted markings in FIG. 2B. The plurality of panels may also include a left side panel 210 and a right side panel 212. The front torso panel 202 may be formed of a left torso portion and a right torso portion, and the front chest panel 204 may be formed of a left chest portion and a right chest portion. The left torso portion and the left chest portion may be divided from the right torso portion and the right chest portion by the closure element.

The front torso panel 202 may extend from a lower front edge of the weighted vest 200 to a lower rib area of the weighted vest 200 and between the left side panel 210 and the right side panel 212. In some embodiments, the front torso panel 202 may be selectively filled with weighted material. The front chest panel 204 may extend from the lower rib area of the weighted vest 200 to an upper chest area of the weighted vest 200. The front chest panel 204 may extend between the left side panel 210 and the right side panel 212. The front chest panel 204 may also extend between two arm openings in the weighted vest 200. In some embodiments, the front chest panel 204 may be selectively filled with weighted material. The amount of weighted material filled in the front torso panel 202 may differ from the amount of weighted material filled in the front chest panel 204 such that the front torso panel 202 makes up a different percentage of the overall weight of the weighted vest 200 than the front chest panel 204.

The shoulder panel 206 may extend from the upper chest area of the weighted vest 200 over a shoulder area to a mid/upper shoulder blade area of the weighted vest 200. In some embodiments, the shoulder panel 206 may be selectively filled with weighted material. The amount of weighted material filled in the shoulder panel 206 may differ from the amount of weighted material filled in the front torso panel 202 and/or the front chest panel 204 such that the shoulder panel 206 makes up a different percentage of the overall weight of the weighted vest 200 than the front torso panel 202 and/or the front chest panel 204.

Lastly, the rear body panel 208 may extend from a lower rear edge of the weighted vest 200 to the mid/upper shoulder blade area of the weighted vest 200. The rear body panel 208 may extend between the left side panel 210 and the right side panel 212. The rear body panel 208 may also extend between the two arm openings in the weighted vest 200. In some embodiments, the rear body panel 208 may be selectively filled with weighted material. The amount of weighted material filled in the rear body panel 208 may differ from the amount of weighted material filled in the front torso panel 202, the front chest panel 204, and/or the shoulder panel 206 such that the rear body panel 208 makes up a different percentage of the overall weight of the weighted vest 200 than the front torso panel 202, the front chest panel 204, and/or the shoulder panel 206.

In some embodiments, the front torso panel 202 and the front chest panel 204 are adjacent to each other in the lower rib area of the weighted vest 200, the front chest panel 204 and the shoulder panel 206 are adjacent to each other in the upper chest area of the weighted vest 200, and the shoulder panel 206 and the rear body panel 208 are adjacent to each other in the mid/upper shoulder blade area of the weighted vest 200.

The plurality of panels, e.g., the front torso panel 202, the front chest panel 204, the shoulder panel 206, and the rear body panel 208, may each include chambers 228*a*, 228*b* filled with weighted pellets. For example, the weighted pellets may be arranged within the chambers 228*a*, 228*b* of the various panels such that the weighted pellets of the front torso panel 202 account for approximately 20%-25%, for example but not limited to approximately 23%, of the overall weight of the weighted vest 200. In still yet other embodiments, the front torso panel 202 may account for approximately 15%-30% of the overall weight of the weighted vest 200. The weighted pellets of the front chest panel 204 account for approximately 25%-30%, for example but not limited to approximately 27%, of the overall weight of the weighted vest 200. In still yet other embodiments, the front chest panel 204 may account for approximately 20%-35% of the overall weight of the weighted vest 200. The weighted pellets of the shoulder panel 206 account for approximately 5%-15%, for example but not limited to approximately 10%, of the overall weight of the weighted vest 200. In still yet other embodiments, the shoulder panel 206 may account for approximately 0%-20% of the overall weight of the weighted vest 200. And the weighted pellets of the rear body panel 208 account for approximately 35%-45%, for example but not limited to approximately 40%, of the overall weight of the weighted vest 200. In still yet other embodiments, the rear body panel 208 may account for approximately 30%-50% of the overall weight of the weighted vest 200.

The chambers 228*a*, 228*b* may be any suitable size and shape, may form any suitable pattern, and may vary depending on the panel. For example, each chamber 228*a* located in the front chest panel 204, the shoulder panel 206, and the rear body panel 208 may each be shaped as parallelograms and arranged substantially vertically to create a chevron pattern. Such chambers 228*a* may be approximately 0.5 inches-2 inches wide, for example but not limited to approximately 1 inch wide, and approximately 2 inches to 4 inches tall, for example but not limited to approximately 3 inches tall. Each chamber 228*b* located in the front torso panel 202 may each be shaped as parallelograms and arranged substantially horizontally to create a stacked pattern slanting down and away from the closure element. Such chambers 228*b* may be approximately 0.5 inches to 2 inches, for example but not limited to approximately 1.25 inches, tall.

Figure 3B:
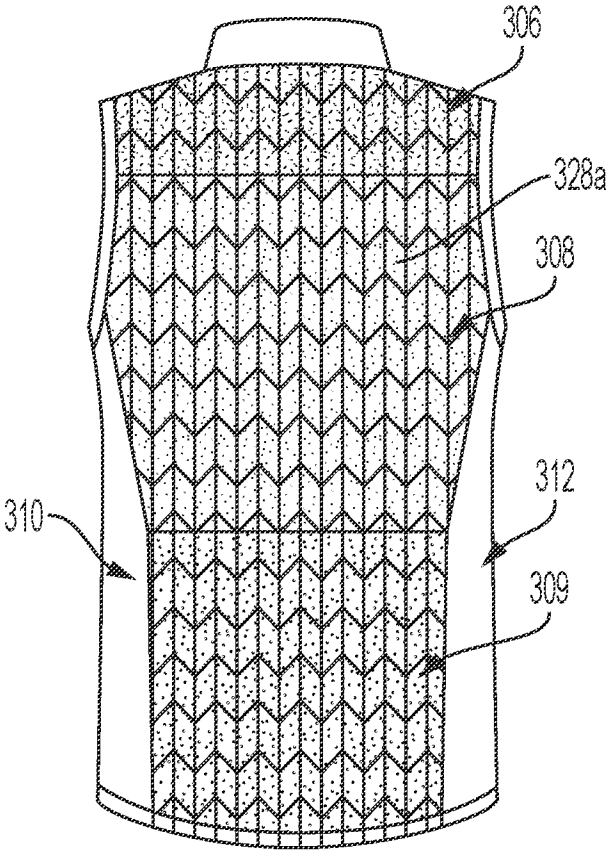
FIGS. 3A-3B illustrate several views of a weighted vest with varying weight distribution according to certain embodiments of the present disclosure.
Figure 3A:
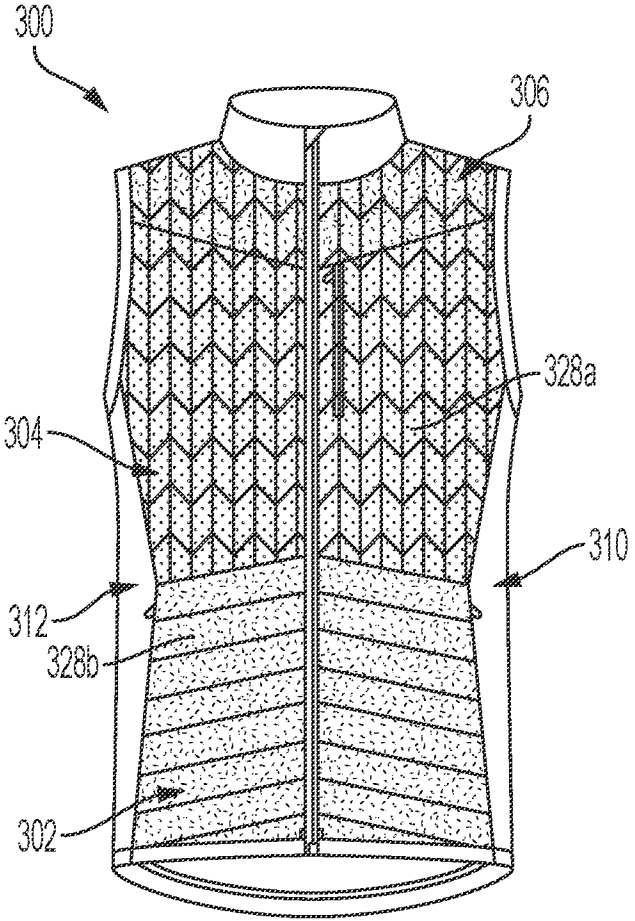

According to certain embodiments of the present disclosure, as shown in FIGS. 3A and 3B, a weighted clothing item, including but not limited to a weighted vest 300, may be the same as the weighted vest 100, 200 and/or include the same or similar elements as the weighted vest 100, 200 discussed in relation to FIGS. 1A-2B. For example, the weighted vest 300 may include a plurality of panels, a plurality of pockets, and a closure element. The weighted vest 300 may include a plurality of chambers 328*a*, 328*b* that may include a weighted material. The distribution of the weighted material within the chambers 328*a*, 328*b* may be selected to provide a desired effect, for example for posture improvement, for use while walking/hiking, for balance improvement, for bone density improvement, for calming anxiety, for increasing calorie burning, for strength training, etc. The distribution of weighted material in the various panels of the weighted vest 300 can also be selected based on the size of the person for whom the weighted vest 300 is intended for, for example a woman or a man, in addition the weighted vest 300 may be provided in various sizes for women, men, and children.

In some embodiments, the plurality of panels includes a front torso panel 302, which is filled with dash-type markings in a lower portion of FIG. 3A, a front chest panel 304, which is in FIG. 3A, a shoulder panel 306, which is filled with dash-type markings in an upper portion of FIGS. 3A and 3B, an upper rear body panel 308, which filled with smaller dotted markings in FIG. 3B, and a lower rear body panel 309, which is filled with dotted markings in FIG. 3B. The plurality of panels may also include a left side panel 310 and a right side panel 312. The front torso panel 302 may be formed of a left torso portion and a right torso portion, and the front chest panel 304 may be formed of a left chest portion and a right chest portion. The left torso portion and the left chest portion may be divided from the right torso portion and the right chest portion by the closure element.

The front torso panel 302 may extend from a lower front edge of the weighted vest 300 to a front, lower rib area of the weighted vest 300 and between the left side panel 310 and the right side panel 312. In some embodiments, the front torso panel 302 may be selectively filled with weighted material. The front chest panel 304 may extend from the front, lower rib area of the weighted vest 300 to an upper chest area of the weighted vest 300. The front chest panel 304 may extend between the left side panel 310 and the right side panel 312. The front chest panel 304 may also extend between two arm openings in the weighted vest 300. In some embodiments, the front chest panel 304 may be selectively filled with weighted material. The amount of weighted material filled in the front torso panel 302 may differ from the amount of weighted material filled in the front chest panel 304 such that the front torso panel 302 makes up a different percentage of the overall weight of the weighted vest 300 than the front chest panel 304.

The shoulder panel 306 may extend from the upper chest area of the weighted vest 300 over a shoulder area to a mid/upper shoulder blade area of the weighted vest 300. In some embodiments, the shoulder panel 306 may be selectively filled with weighted material. The amount of weighted material filled in the shoulder panel 306 may differ from the amount of weighted material filled in the front torso panel 302 and/or the front chest panel 304 such that the shoulder panel 306 makes up a different percentage of the overall weight of the weighted vest 300 than the front torso panel 302 and/or the front chest panel 304.

The upper rear body panel 308 may extend from the mid/upper shoulder blade area of the weighted vest 300 to a rear, lower rib area of the weighted vest 300. The upper rear body panel 308 may extend between the left side panel 310 and the right side panel 312. The upper rear body panel 308 may also extend between the two arm openings in the weighted vest 300. In some embodiments, the upper rear body panel 308 may be selectively filled with weighted material. The amount of weighted material filled in the upper rear body panel 308 may differ from the amount of weighted material filled in the front torso panel 302, the front chest panel 304, and/or the shoulder panel 306 such that the upper rear body panel 308 makes up a different percentage of the overall weight of the weighted vest 300 than the front torso panel 302, the front chest panel 304, and/or the shoulder panel 306.

Lastly, the lower rear body panel 309 may extend from the rear, lower rib area of the weighted vest 300 to a lower rear edge of the weighted vest 300 and between the left side panel 310 and the right side panel 312. In some embodiments, the upper rear body panel 308 may be selectively filled with weighted material. The amount of weighted material filled in the lower rear body panel 309 may differ from the amount of weighted material filled in the front torso panel 302, the front chest panel 304, the shoulder panel 306, and/or the upper rear body panel 308 such that the lower rear body panel 309 makes up a different percentage of the overall weight of the weighted vest 300 than the front torso panel 302, the front chest panel 304, the shoulder panel 306, and/or the upper rear body panel 308.

In some embodiments, the front torso panel 302 and the front chest panel 304 are adjacent to each other in the front, lower rib area of the weighted vest 300, the front chest panel 304 and the shoulder panel 306 are adjacent to each other in the upper chest area of the weighted vest 300, the shoulder panel 306 and the upper rear body panel 308 are adjacent to each other in the mid/upper shoulder blade area of the weighted vest 300, and the upper rear body panel 308 and the lower rear body panel 309 are adjacent to each other in the rear, lower rib are of the weighted vest 300.

The plurality of panels, e.g., the front torso panel 302, the front chest panel 304, the shoulder panel 306, the upper rear body panel 308, and the lower rear body panel 309, may each include chambers 328*a*, 328*b* filled with weighted pellets such that the weighted vest 300 has a varied weight distribution throughout the weighted vest 300 and between the plurality of panels relative to the total weight of the weighted vest 300.

For example, the weighted pellets may be arranged within the chambers 328*a*, 328*b* of the various panels such that the weighted pellets of the front torso panel 302 may account for approximately 5%, 10%, 13%, 15%, 5%-15%, 5%-13%, 5%-10%, 10%-15%, 10%-13%, or 13%-15% of the overall weight of the weighted vest 300. The weighted pellets of the front chest panel 304 may account for approximately 20%, 25%, 30%, 33%, 20%-33%, 20%-30%, 20%-25%, 25%-33%, 25%-30%, or 30%-33% of the overall weight of the weighted vest 300. The weighted pellets of the shoulder panel 306 may account for approximately 20%, 28%, 30%, 40%, 20%-40%, 20%-30%, 20%-28%, 28%-40%, 28%-30%, or 30%-40% of the overall weight of the weighted vest 300. The weighted pellets of the upper rear body panel 308 may account for approximately 18%, 25%, 30%, 18%-30%, 18%-25%, or 25%-30% of the overall weight of the weighted vest 300. The weighted pellets of the lower rear body panel 309 may account for approximately 5%, 8%, 10%, 15%, 5%-15%, 5%-10%, 5%-8%, 8%-15%, 8%-10%, or 10%-15% of the overall weight of the weighted vest 300.

In some embodiments, the weight distribution of each of the plurality of panels may be selected during the manufacturing of the weighted vest 300 based on an intended use of the weighted vest 300, e.g., posture improvement, use while walking/hiking, for balance improvement, for bone density improvement, for calming of anxiety, etc., that the weighted vest 300 may be used for. The weight distribution of weighted material in each of the plurality of panels may be based on the size of the weighted vest 300, based on the gender and/or age of the wearer, etc.

In some embodiments, the weighted pellets may be arranged within the chambers 328*a*, 328*b* of each of the plurality of panels so that the targeted weight distribution of the weighted vest 300 assists in achieving the desired function of improving posture. For example, the weighted pellets of the front torso panel 302 may account for approximately 5%-15%, for example but not limited to approximately 10%, of the overall weight of the weighted vest 300, the weighted pellets of the front chest panel 304 may account for approximately 20%-33%, for example but not limited to approximately 20%, of the overall weight of the weighted vest 300, the weighted pellets of the shoulder panel 306 may account for approximately 20%-40%, for example but not limited to approximately 30%, of the overall weight of the weighted vest 300, the weighted pellets of the upper rear body panel 308 may account for approximately 18%-30%, for example but not limited to approximately 30%, of the overall weight of the weighted vest 300, and the weighted pellets of the lower rear body panel 309 may account for approximately 5%-15%, for example but not limited to approximately 10%, of the overall weight of the weighted vest 300.

The weight distribution of the weighted pellets in grams based on a 5 lbs. (2,268 g) weighted vest 300 intended for use by a woman wearing a size small designed to improve posture may be approximately 110 g to 340 g, for example but not limited to approximately 230 g, in the front torso panel 302, approximately 450 g to 750 g, for example but not limited to approximately 450 g, in the front chest panel 304, approximately 450 g to 910 g, for example but not limited to approximately 680 g, in the shoulder panel 306, approximately 410 g to 680 g, for example but not limited to approximately 680 g, in the upper rear body panel 308, and approximately 110 g to 340 g, for example but not limited to approximately 230 g, in the lower rear body panel 309. However, the total weight and weight distribution of the weighted clothing item may vary based on size, the gender of the wearer, or the type of clothing item. For example, the total weight of the weighted vest 300 designed to improve posture may vary between 3 lbs. and 12 lbs. depending on the gender and size of the clothing item.

In some embodiments, the weighted pellets may be arranged within the chambers 328*a*, 328*b* of each of the plurality of panels so that the targeted weight distribution of the weighted vest 300 assists in achieving the desired function of increasing the fitness level during walking and/or hiking. For example, the weighted pellets of the front torso panel 302 may account for approximately 5%-15%, for example but not limited to approximately 13%, of the overall weight of the weighted vest 300, the weighted pellets of the front chest panel 304 may account for approximately 20%-33%, for example but not limited to approximately 33%, of the overall weight of the weighted vest 300, the weighted pellets of the shoulder panel 306 may account for approximately 20%-40%, for example but not limited to approximately 28%, of the overall weight of the weighted vest 300, the weighted pellets of the upper rear body panel 308 may account for approximately 18%-30%, for example but not limited to approximately 18%, of the overall weight of the weighted vest 300, and the weighted pellets of the lower rear body panel 309 may account for approximately 5%-15%, for example but not limited to approximately 8%, of the overall weight of the weighted vest 300.

The weight distribution of the weighted pellets in grams based on a 5 lbs. (2,268 g) weighted vest 300 designed for use by a woman wearing a size small during walking and/or hiking may be approximately 110 g to 340 g, for example but not limited to approximately 300 g, in the front torso panel 302, approximately 450 g to 750 g, for example but not limited to approximately 750 g, in the front chest panel 304, approximately 450 g to 910 g, for example but not limited to approximately 640 g, in the shoulder panel 306, approximately 410 g to 680 g, for example but not limited to approximately 410 g, in the upper rear body panel 308, and approximately 110 g to 340 g, for example but not limited to approximately 180 g, in the lower rear body panel 309. However, the total weight and weight distribution of the weighted clothing item may vary based on size, the gender of the wearer, or the type of clothing item. For example, the total weight of the weighted vest 300 designed for use during walking and/or hiking may vary between 3 lbs. and 12 lbs. depending on the gender and size of the clothing item.

In some embodiments, the weighted pellets may be arranged within the chambers 328*a*, 328*b* of each of the plurality of panels so that the targeted weight distribution of the weighted vest 300 assists in achieving the desired function of improving balance. For example, the weighted pellets of the front torso panel 302 may account for approximately 5%-15%, for example but not limited to approximately 5%, of the overall weight of the weighted vest 300, the weighted pellets of the front chest panel 304 may account for approximately 20%-33%, for example but not limited to approximately 30%, of the overall weight of the weighted vest 300, the weighted pellets of the shoulder panel 306 may account for approximately 20%-40%, for example but not limited to approximately 30%, of the overall weight of the weighted vest 300, the weighted pellets of the upper rear body panel 308 may account for approximately 18%-30%, for example but not limited to approximately 30%, of the overall weight of the weighted vest 300, and the weighted pellets of the lower rear body panel 309 may account for approximately 5%-15%, for example but not limited to approximately 5%, of the overall weight of the weighted vest 300.

The weight distribution of the weighted pellets in grams based on a 5 lbs. (2,268 g) weighted vest 300 designed for use by a woman wearing a size small to improve balance may be approximately 110 g to 340 g, for example but not limited to approximately 110 g, in the front torso panel 302, approximately 450 g to 750 g, for example but not limited to approximately 680 g, in the front chest panel 304, approximately 450 g to 910 g, for example but not limited to approximately 680 g, in the shoulder panel 306, approximately 410 g to 680 g, for example but not limited to approximately 680 g, in the upper rear body panel 308, and approximately 110 g to 340 g, for example but not limited to approximately 110 g, in the lower rear body panel 309. However, the total weight and weight distribution of the weighted clothing item may vary based on size, the gender of the wearer, or the type of clothing item. For example, the total weight of the weighted vest 300 designed to improve balance may vary between 3 lbs. and 12 lbs. depending on the gender and size of the clothing item.

In some embodiments, the weighted pellets may be arranged within the chambers 328*a*, 328*b* of each of the plurality of panels so that the targeted weight distribution of the weighted vest 300 assists in achieving the desired function of improving bone density. For example, the weighted pellets of the front torso panel 302 may account for approximately 5%-15%, for example but not limited to approximately 5%, of the overall weight of the weighted vest 300, the weighted pellets of the front chest panel 304 may account for approximately 20%-33%, for example but not limited to approximately 25%, of the overall weight of the weighted vest 300, the weighted pellets of the shoulder panel 306 may account for approximately 20%-40%, for example but not limited to approximately 40%, of the overall weight of the weighted vest 300, the weighted pellets of the upper rear body panel 308 may account for approximately 18%-30%, for example but not limited to approximately 25%, of the overall weight of the weighted vest 300, and the weighted pellets of the lower rear body panel 309 may account for approximately 5%-15%, for example but not limited to approximately 5%, of the overall weight of the weighted vest 300.

The weight distribution of the weighted pellets in grams based on a 5 lbs. (2,268 g) women's small weighted vest 300 designed to improve bone density may be approximately 110 g to 340 g, for example but not limited to approximately 110 g, in the front torso panel 302, approximately 450 g to 750 g, for example but not limited to approximately 570 g, in the front chest panel 304, approximately 450 g to 910 g, for example but not limited to approximately 910 g, in the shoulder panel 306, approximately 410 g to 680 g, for example but not limited to approximately 570 g, in the upper rear body panel 308, and approximately 110 g to 340 g, for example but not limited to approximately 110 g, in the lower rear body panel 309. However, the total weight and weight distribution of the weighted clothing item may vary based on size, the gender of the wearer, or the type of clothing item. For example, the total weight of the weighted vest 300 designed to improve bone density may vary between 3 lbs. and 12 lbs. depending on the gender and size of the clothing item.

In some embodiments, the weighted pellets may be arranged within the chambers 328*a*, 328*b* of each of the plurality of panels so that the targeted weight distribution of the weighted vest 300 assists in achieving the desired function of calming anxiety. For example, the weighted pellets of the front torso panel 302 may account for approximately 5%-15%, for example but not limited to approximately 15%, of the overall weight of the weighted vest 300, the weighted pellets of the front chest panel 304 may account for approximately 20%-33%, for example but not limited to approximately 25%, of the overall weight of the weighted vest 300, the weighted pellets of the shoulder panel 306 may account for approximately 20%-40%, for example but not limited to approximately 20%, of the overall weight of the weighted vest 300, the weighted pellets of the upper rear body panel 308 may account for approximately 18%-30%, for example but not limited to approximately 25%, of the overall weight of the weighted vest 300, and the weighted pellets of the lower rear body panel 309 may account for approximately 5%-15%, for example but not limited to approximately 15%, of the overall weight of the weighted vest 300.

The weight distribution of the weighted pellets in grams based on a 5 lbs. (2,268 g) weighted vest 300 designed to calm anxiety may be approximately 110 g to 340 g, for example but not limited to approximately 340 g, in the front torso panel 302, approximately 450 g to 750 g, for example but not limited to approximately 570 g, in the front chest panel 304, approximately 450 g to 910 g, for example but not limited to approximately 450 g, in the shoulder panel 306, approximately 410 g to 680 g, for example but not limited to approximately 570 g, in the upper rear body panel 308, and approximately 110 g to 340 g, for example but not limited to approximately 340 g, in the lower rear body panel 309. However, the total weight and weight distribution of the weighted clothing item may vary based on size, the gender of the wearer, or the type of clothing item. For example, the total weight of the weighted vest 300 designed to calm anxiety may vary between 3 lbs. and 12 lbs. depending on the gender and size of the clothing item.

Weighted clothing items according to embodiments of the present disclosure, including but not limited to weighted vests 100, 200, 300, are designed to have a unique construction and weight distribution that is purposefully engineered to increase the physical and mental benefits provided by the weighted vest 100, 200, 300 while maintaining the comfort of the wearer while the weighted vest 100, 200, 300 is worn. The weighted vest 100, 200, 300 may have a targeted weight distribution based on achieving a desired function, e.g., improving posture, use during walking and/or hiking, improving balance, improving bone density, calming anxiety, etc.

The overall weight of the weighted vest 100, 200, 300 may vary depending on the size, style, or intended use of the vest. For example, a men's size large weighted vest 100, 200, 300 may be heavier than a women's size large weighted vest 100, 200, 300, which may be heavier than a child's size large weighted vest 100, 200, 300. The overall weight of the weighted vest 100, 200, 300 may range from approximately 1 pound to approximately 20 pounds, from approximately 2 pounds to approximately 15 pounds, from approximately 5 pounds to approximately 10 pounds, from approximately 6 pounds to approximately 9 pounds, from approximately 7 pounds, to approximately 8 pounds, etc.

In some embodiments, the weight distribution of the weighted vest 100, 200, 300 is not adjustable by the wearer but may be determined by the size, style, or intended use of the vest selected. The set weight distribution within the weighted vest 100, 200, 300 may reduce the likelihood of injury because the wearer is not able to distribute the weight or arrange the weight to size ratio incorrectly.

Due to the design, overall weight, weight distribution, and general comfort of the weighted vest 100, 200, 300, the wearer may wear the weighted vest 100, 200, 300 on a daily basis during exercising or even during everyday tasks such as grocery shopping or walking the dog. Thus, the weighted vest 100, 200, 300 is able to provide physical, mental, emotional, and general wellbeing benefits. For example, the physical benefits may include calorie burning, increased fitness, weight loss, increased muscle mass, improved bone health, improved posture, improved balance, and improved stamina. The mental benefits provided by the weighted vest 100, 200, 300 may include calming acupressure, anxiety reduction, and increased proprioception, which is an individual's sense of self-movement and body position. For example, in some embodiments the weighted vest 100, 200, 300 may provide for increased weight along the tops of the shoulders area corresponding to the shoulder panel 206 of the weighted vest 200 for providing a calming and relaxing pressure in that area. In addition, the weighted vest 100, 200, 300 may provide for weight in specific areas which are safer to carry additional weight while refraining from adding weight to areas that are more likely to induce injury. For example, in some embodiments, the weighted vest 100, 200, 300 may not include weighted pellets or may include a smaller amount of weighted pellets along the sides, e.g., left side panel 110 and right side panel 112 of the weighted vest 100, and/or in the front lower region or the back lower region.

Though FIGS. 1A-3B depict weighted vests 100, 200, 300, the present disclosure is not limited to vests in particular. For example, weighted clothing items having similar features as those depicted and described herein with respect to weighted vests 100, 200, 300 may include long sleeve tee-shirts, short sleeve tee-shirts, jackets, sweatshirts, or other similar clothing items. As disclosed herein, those clothing items can include a combination of regions having chambers including weighted pellets, regions having empty chambers, and/or regions having no chambers.

The weighted vest 100, 200, 300 may be manufactured using any suitable method of manufacturing. For example, the weighted vest 100, 200, 300 may be formed by connecting a plurality of material pieces. Within the area of each respective panel, the chambers may be formed by sewing the borders of the chambers. In some embodiments, the individual chambers are filled with the desired amount of weighted pellets after at least one of the respective borders is formed. In some embodiments, a roll of fabric may be include pre-filled chambers or may include preformed chambers that are ready to receive a weighted material. In further embodiments, the area of each respective panel may be filled with the weighted material, for example but not limited to weighted pellets and the individual chambers may then be sewn to encompass the desired amount of weighted pellets.

Additionally, the weighted vest 100, 200, 300 may be formed by connecting preformed, weighted panels and optionally non-weighted panels. For example, individual weighted panels, e.g., the front upper body panel 104, the front lower body panel 106, the rear body panel 108, the front torso panel 202, the front chest panel 204, the shoulder panel 206, the rear body panel 208, the front torso panel 302, the front chest panel 304, the shoulder panel 306, the upper rear body panel 308, the lower rear body panel 309, etc., may have the chambers sewn and filled with the weighted pellets. The preformed, weighted panels may then be connected to form the weighted vest 100, 200, 300 based on desired number of panels and the desired weight distribution among the panels.

In the following, further examples are described to facilitate the understanding of the invention (and in some aspects, features of an apparatus or system described in one or more of these examples may be utilized in a method described in one of the other examples or vice versa). These examples are not meant to be mutually exclusive, exhaustive, or restrictive; and the disclosure is not limited to these examples but rather encompasses all possible modifications and variations within the scope of the issued claims and their equivalents.

Example 1. A weighted article of wear for daily wear (which may incorporate features of any of the subsequent examples), the weighted article of wear comprising: a first panel comprising a plurality of first panel chambers, each of the first panel chambers of the plurality of first panel chambers further comprising a plurality of weighted pellets positioned therein; and a second panel comprising a plurality of second panel chambers, each of the second panel chambers of the plurality of second panel chambers further comprising a plurality of weighted pellets positioned therein; wherein each of the first panel chambers are defined by a seam line that separates each of the first panel chambers from an adjacent first panel chamber for preventing the plurality of weighted pellets from moving between adjacent first panel chambers; wherein each of the second panel chambers are defined by a seam line that separates each of the second panel chambers from an adjacent second panel chamber for preventing the plurality of weighted pellets from moving between adjacent second panel chambers; and wherein the plurality of weighted pellets are distributed within each of the first panel chambers of the plurality of first panel chambers and each of the second panel chambers of the plurality of second panel chambers so that the first panel weighs more than the second panel and the plurality of weighted pellets are not redistributable by a wearer.

Example 2. The weighted article of wear of Example 1 or any of the preceding or subsequent examples, further comprising: a third panel comprising a plurality of third panel chambers, each of the third panel chambers of the plurality of third panel chambers further comprising a plurality of weighted pellets positioned therein; and a fourth panel comprising a plurality of fourth panel chambers, each of the fourth panel chambers of the plurality of fourth panel chambers further comprising a plurality of weighted pellets positioned therein; wherein each of the third panel chambers are defined by a seam line that separates each of the third panel chambers from an adjacent third panel chamber for preventing the plurality of weighted pellets from moving between adjacent third panel chambers; wherein each of the fourth panel chambers are defined by a seam line that separates each of the fourth panel chambers from an adjacent fourth panel chamber for preventing the plurality of weighted pellets from moving between adjacent fourth panel chambers; and wherein the plurality of weighted pellets are distributed within each of the third panel chambers of the plurality of third panel chambers and each of the fourth panel chambers of the plurality of fourth panel chambers so that the third panel weighs more than the fourth panel and the plurality of weighted pellets are not redistributable by the wearer.

Example 3. The weighted article of wear of Example 2 or any of the preceding or subsequent examples, wherein the second panel accounts for approximately 5%-15% of the overall weight of the weighted article of wear, the first panel accounts for approximately 20%-25% of the overall weight of the weighted article of wear, the fourth panel accounts for approximately 25%-30% of the overall weight of the weighted article of wear, and the third panel accounts for approximately 35%-45% of the overall weight of the weighted article of wear.

Example 4. The weighted article of wear of Example 2 or any of the preceding or subsequent examples, wherein the weighted article of wear has a varied weight distribution between the first panel, the second panel, the third panel, and the fourth panel.

Example 5. The weighted article of wear of Example 2 or any of the preceding or subsequent examples, wherein a distribution of the plurality of weighted pellets within the respective first panel chambers, second panel chambers, third panel chambers, and fourth panel chambers of each of the first panel, the second panel, the third panel, and the fourth panel is determined based on a desired effect that the weighted article of wear will have on the wearer when the weighted article of wear is worn, wherein the desired effect comprises posture improvement, balance improvement, bone density improvement, or calming anxiety.

Example 6. The weighted article of wear of Example 1 or any of the preceding or subsequent examples, wherein the overall weight of the weighted article of wear is between 3 lbs. and 12 lbs.

Example 7. The weighted article of wear of Example 1 or any of the preceding or subsequent examples, wherein the weighted article of wear comprises a vest.

Example 8. A weighted article of wear for daily wear (which may incorporate features of any of the preceding or subsequent examples), the weighted article of wear comprising: a plurality of panels, each of the plurality of panels comprising a plurality of chambers comprising a plurality of weighted pellets positioned therein; wherein each chamber of the plurality of chambers is defined by a plurality of seam lines that contain the plurality of weighted pellets within each of the respective plurality of chambers so as to prevent the plurality of weighted pellets from moving between adjacent chambers; and wherein the plurality of weighted pellets are distributed within the plurality of chambers so that at least one of the plurality of panels weighs more than a second of the plurality of panels and the plurality of weighted pellets are not redistributable by a wearer.

Example 9. The weighted article of wear of Example 8 or any of the preceding or subsequent examples, wherein a distribution of the plurality of weighted pellets within the plurality of chambers of each of the plurality of panels is determined based on a desired effect that the weighted article of wear will have on the wearer when the weighted article of wear is worn, wherein the desired effect comprises posture improvement, balance improvement, bone density improvement, or calming anxiety.

Example 10. The weighted article of wear of Example 8 or any of the preceding or subsequent examples, wherein the plurality of panels further comprise a second plurality of chambers that do not include weighted pellets.

Example 11. The weighted article of wear of Example 8 or any of the preceding or subsequent examples, further comprising a plurality of second panels that do not include weighted pellets.

Example 12. The weighted article of wear of Example 8 or any of the preceding or subsequent examples, wherein the plurality of chambers further comprises a fill material.

Example 13. The weighted article of wear of Example 8 or any of the preceding or subsequent examples, wherein the overall weight of the weighted article of wear is between 3 lbs. and 12 lbs.

Example 14. The weighted article of wear of Example 8 or any of the preceding or subsequent examples, wherein the weighted article of wear comprises a vest.

Example 15. A method (which may incorporate features of any of the preceding or subsequent examples) of manufacturing a weighted article of wear comprising a plurality of panels, each of the plurality of panels comprising a plurality of chambers, the method comprising: filling the plurality of chambers with a plurality of weighted pellets; defining each chamber of the plurality of chambers by a plurality of seam lines that contain the plurality of weighted pellets within each of the respective plurality of chambers so as to prevent the plurality of weighted pellets from moving between adjacent chambers; and distributing the plurality of weighted pellets within the plurality of chambers so that at least one of the plurality of panels weighs more than a second of the plurality of panels and the plurality of weighted pellets are not redistributable by a wearer.

Example 16. The method of Example 15 or any of the preceding or subsequent examples, wherein isolating each chamber of the plurality of chambers from an adjacent chamber comprises forming a seam line that separates each chamber of the plurality of chamber from an adjacent chamber.

Example 17. The method of Example 15 or any of the preceding or subsequent examples, further comprising forming each of the plurality of panels separately and connecting each of the separately formed plurality of panels.

Example 18. The method of Example 15 or any of the preceding or subsequent examples, wherein the distribution of the plurality of weighted pellets within the plurality of chambers is determined based on a desired effect that the weighted article of wear will have on the wearer when the weighted article of wear is worn, wherein the desired effect comprises posture improvement, balance improvement, bone density improvement, or calming anxiety.

Example 19. The method of Example 15 or any of the preceding or subsequent examples, wherein the plurality of panels comprise a second plurality of chambers of the plurality of panels.

Example 20. The method of Example 15 or any of the preceding examples, wherein the weighted article of wear further comprises a plurality of second panels that do not include weighted pellets.

It is to be understood that the above description is intended to be illustrative and not restrictive. Many embodiments will be apparent to those of skill in the art upon reviewing the above description. The scope of the invention should, therefore, be determined not with reference to the above description, but instead should be determined with reference to the appended claims along with their full scope of equivalents.

While the foregoing disclosure shows illustrative aspects of the disclosure, it should be noted that various changes and modifications could be made herein without departing from the scope of the disclosure as defined by the appended claims. The functions, steps and/or actions of the method claims in accordance with the aspects of the disclosure described herein need not be performed in any particular order. Furthermore, although elements of the disclosure may be described or claimed in the singular, the plural is contemplated unless limitation to the singular is explicitly stated.

What is claimed is:

1. A weighted article of wear for daily wear, the weighted article of wear comprising:

a front panel configured to cover a front of a wearer and comprising a plurality of front panel chambers, each of the front panel chambers of the plurality of front panel chambers further comprising a first plurality of weighted pellets positioned therein, wherein:

each of the front panel chambers are defined by a front seam line that separates each of the front panel chambers from an adjacent front panel chamber for preventing the first pluralities of weighted pellets from moving between adjacent front panel chambers;

the front panel includes a chest panel configured to support a chest of the wearer, the chest panel comprising a chest panel chamber subset of the front panel chambers, each panel chamber of the chest panel chamber subset further comprising a chest panel weighted pellet subset of the first pluralities of weighted pellets positioned therein, wherein each of the chest panel chamber subset is defined by a chest seam line subset of the front seam lines that separates each of the chest panel chamber subset from an adjacent panel chamber of the chest panel chamber subset for preventing the chest panel weighted pellet subsets from moving between adjacent panel chambers of the chest panel chamber subset; and the front panel includes a lower front body panel configured to support a lower front body of the wearer, the lower front body panel comprising a lower front panel chamber subset of the front panel chambers, each of the lower front panel chamber subset further comprising a lower front panel weighted pellet subset of the first pluralities of weighted pellets positioned therein;

a rear panel configured to cover a rear of the wearer and comprising a plurality of rear panel chambers, each of the rear panel chambers of the plurality of rear panel chambers further comprising a second plurality of weighted pellets positioned therein, wherein:

each of the rear panel chambers are defined by a rear seam line that separates each of the rear panel chambers from an adjacent rear panel chamber for preventing the second pluralities of weighted pellets from moving between adjacent rear panel chambers; and the rear panel includes an upper rear body panel configured to support an upper rear body of the wearer, the upper rear body panel comprising an upper rear panel chamber subset of the rear panel chambers, each of the upper rear panel chamber subset further comprising an upper rear panel weighted pellet subset of the second pluralities of weighted pellets positioned therein, wherein each of the upper rear panel chamber subset is defined by an upper rear seam line subset of the rear seam lines that separates each of the upper rear panel chamber subset from an adjacent panel chamber of the upper rear panel chamber subset for preventing the upper rear panel weighted pellet subsets from moving between adjacent panel chambers of the upper rear panel chamber subset; and a shoulder panel configured to cover a shoulder of the wearer and comprising a plurality of shoulder panel chambers, each of the shoulder panel chambers of the plurality of shoulder panel chambers further comprising a third plurality of weighted pellets positioned therein, wherein:

the shoulder panel accounts for approximately 5%-15% of an overall weight of the weighted article of wear, the lower front body panel accounts for approximately 20%-25% of the overall weight of the weighted article of wear, the chest panel accounts for approximately 25%-30% of the overall weight of the weighted article of wear, and the upper rear body panel accounts for approximately 35%-45% of the overall weight of the weighted article of wear;

the first, second, and third pluralities of weighted pellets are distributed within the front panel chambers, the rear panel chambers, and the shoulder panel chambers, respectively, such that each of the front panel, the rear panel, and the shoulder panel have a different weight; and the first, second, and third pluralities of weighted pellets are not redistributable by the wearer.

2. The weighted article of wear of claim 1, wherein the weighted article of wear has a varied weight distribution between the lower front body panel, the shoulder panel, the rear panel, and the chest panel.

3. The weighted article of wear of claim 1, wherein a distribution of the lower front panel weighted pellet subsets, the third pluralities of weighted pellets, the second pluralities of weighted pellets, and the chest panel weighted pellet subsets within the respective lower front panel chamber subset, shoulder panel chambers, rear panel chambers, and chest panel chamber subset of each of the lower front body panel, the shoulder panel, the rear panel, and the chest panel is determined based on a desired effect that the weighted article of wear will have on the wearer when the weighted article of wear is worn, wherein the desired effect comprises posture improvement, balance improvement, bone density improvement, or calming anxiety.

4. The weighted article of wear of claim 1, wherein the overall weight of the weighted article of wear is between 3 lbs. and 12 lbs.

5. A weighted article of wear for daily wear, the weighted article of wear comprising:

a front panel configured to cover a front of a wearer and comprising a plurality of front panel chambers, each of the front panel chambers of the plurality of front panel chambers further comprising a first plurality of weighted pellets positioned therein, wherein:

each of the front panel chambers are defined by a front seam line that separates each of the front panel chambers from an adjacent front panel chamber for preventing the first pluralities of weighted pellets from moving between adjacent front panel chambers;

the front panel includes a chest panel configured to support a chest of the wearer, the chest panel comprising a chest panel chamber subset of the front panel chambers, each panel chamber of the chest panel chamber subset further comprising a chest panel weighted pellet subset of the first pluralities of weighted pellets positioned therein, wherein each of the chest panel chamber subset is defined by a chest seam line subset of the front seam lines that separates each of the chest panel chamber subset from an adjacent panel chamber of the chest panel chamber subset for preventing the chest panel weighted pellet subsets from moving between adjacent panel chambers of the chest panel chamber subset; and the front panel includes a lower front body panel configured to support a lower front body of the wearer, the lower front body panel comprising a lower front panel chamber subset of the front panel chambers, each of the lower front panel chamber subset further comprising a lower front panel weighted pellet subset of the first pluralities of weighted pellets positioned therein;

a rear panel configured to cover a rear of the wearer and comprising a plurality of rear panel chambers, each of the rear panel chambers of the plurality of rear panel chambers further comprising a second plurality of weighted pellets positioned therein, wherein:

each of the rear panel chambers are defined by a rear seam line that separates each of the rear panel chambers from an adjacent rear panel chamber for preventing the second pluralities of weighted pellets from moving between adjacent rear panel chambers;

the rear panel includes an upper rear body panel configured to support an upper rear body of the wearer, the upper rear body panel comprising an upper rear panel chamber subset of the rear panel chambers, each of the upper rear panel chamber subset further comprising an upper rear panel weighted pellet subset of the second pluralities of weighted pellets positioned therein, wherein each of the upper rear panel chamber subset is defined by an upper rear seam line subset of the rear seam lines that separates each of the upper rear panel chamber subset from an adjacent panel chamber of the upper rear panel chamber subset for preventing the upper rear panel weighted pellet subsets from moving between adjacent panel chambers of the upper rear panel chamber subset; and the chest panel weighted pellet subsets and the upper rear panel weighted pellet subsets are distributed within the chest panel chamber subset and the upper rear panel chamber subset, respectively, such that the chest panel and the upper rear body panel have a different weight; and a shoulder panel configured to cover a shoulder of the wearer and comprising a plurality of shoulder panel chambers, each of the shoulder panel chambers of the plurality of shoulder panel chambers further comprising a third plurality of weighted pellets positioned therein, wherein:

the first, second, and third pluralities of weighted pellets are distributed within the front panel chambers, the rear panel chambers, and the shoulder panel chambers, respectively, such that each of the front panel, the rear panel, and the shoulder panel has a different weight;

the first, second, and third pluralities of weighted pellets are not redistributable by the wearer;

a distribution of the lower front panel weighted pellet subsets, third pluralities of weighted pellets, second pluralities of weighted pellets, and chest panel weighted pellet subsets within the respective lower front panel chamber subset, shoulder panel chambers, rear panel chambers, and chest panel chamber subset of each of the lower front body panel, the shoulder panel, the rear panel, and the chest panel is determined based on a desired effect that the weighted article of wear will have on the wearer when the weighted article of wear is worn; and the desired effect comprises posture improvement, balance improvement, bone density improvement, or calming anxiety.

6. The weighted article of wear of claim 5, wherein at least one of the front panel, rear panel, or shoulder panel includes a plurality of chambers that do not include weighted pellets.

7. The weighted article of wear of claim 5, further comprising a plurality of lower front panels that do not include weighted pellets.

8. The weighted article of wear of claim 5, wherein:

the pluralities of front panel chambers, the rear panel chambers, and the shoulder panel chambers further comprise a fill material intermixed with the respective weighted pellets.

9. The weighted article of wear of claim 5, wherein an overall weight of the weighted article of wear is between 3 lbs. and 12 lbs.

10. The weighted article of claim 5, wherein:

the rear panel includes a lower rear body panel configured to support a lower rear body of the wearer, the lower rear body panel comprising a lower rear panel chamber subset of the rear panel chambers, each of the lower rear panel chamber subset further comprising a lower rear panel weighted pellet subset of the second pluralities of weighted pellets; and the chest panel accounts for approximately 20%-33% of an overall weight of the weighted article of wear, the lower front body panel accounts for approximately 5%-15% of the overall weight of the weighted article of wear, the shoulder panel accounts for approximately 20%-40% of the overall weight of the weighted article of wear, the upper rear body panel accounts for approximately 18%-30% of the overall weight of the weighted article of wear, and the lower rear body panel accounts for approximately 5%-15% of the overall weight of the weighted article of wear.

11. A method of manufacturing a weighted article of wear comprising a plurality of panels, wherein the plurality of panels includes a front panel configured to cover a front of a wearer, the front panel includes an upper front body panel configured to support an upper front body of the wearer and a lower front body panel configured to support a lower front body of the wearer, a rear panel configured to cover a rear of the wearer, the rear panel including an upper rear body panel configured to support an upper rear body of the wearer and a lower rear body panel configured to support a lower rear body of the wearer, and a shoulder panel configured to cover a shoulder of the wearer, each of the plurality of panels comprising a plurality of chambers, the method comprising:

filling the pluralities of chambers with a plurality of weighted pellets;

defining each chamber of the pluralities of chambers by a plurality of seam lines that contain the plurality of weighted pellets within each of the respective plurality of chambers so as to prevent the plurality of weighted pellets from moving between adjacent chambers; and distributing the plurality of weighted pellets within the respective plurality of chambers so that each of the front panel, rear panel, and shoulder panel weigh differently and the plurality of weighted pellets are not redistributable by a wearer, wherein:

the upper front body panel includes a first weight, the lower front body panel includes a second weight, the shoulder panel includes a third weight, the upper rear body panel includes a fourth weight, and the lower rear body panel includes a fifth weight; and the third weight is greater than the first weight, the first weight is greater than the fourth weight, and the fourth weight is greater than either of the second weight or the fifth weight.

12. The method of claim 11, wherein defining each chamber of the pluralities of chambers isolates each chamber of the pluralities of chambers from an adjacent chamber by forming a seam line of the plurality of seam lines that separates each chamber of the pluralities of chambers from the respective adjacent chamber.

13. The method of claim 11, further comprising forming each of the plurality of panels separately and connecting each of the separately formed plurality of panels.

14. The method of claim 11, wherein the distribution of the plurality of weighted pellets within the pluralities of chambers is determined based on a desired effect that the weighted article of wear will have on the wearer when the weighted article of wear is worn, wherein the desired effect comprises posture improvement, balance improvement, bone density improvement, or calming anxiety.

15. The method of claim 11, wherein the plurality of panels comprise a second plurality of chambers.

16. The method of claim 11, wherein the weighted article of wear further comprises a plurality of second panels that do not include weighted pellets.

17. The method of claim 11, wherein:

the upper front body panel accounts for approximately 20%-33% of an overall weight of the weighted article of wear, the lower front body panel accounts for approximately 5%-15% of the overall weight of the weighted article of wear, the shoulder panel accounts for approximately 20%-40% of the overall weight of the weighted article of wear, the upper rear body panel accounts for approximately 18%-30% of the overall weight of the weighted article of wear, and the lower rear body panel accounts for approximately 5%-15% of the overall weight of the weighted article of wear.

* * * * *